US009557047B2

(12) United States Patent
Tsai et al.

(10) Patent No.: US 9,557,047 B2
(45) Date of Patent: Jan. 31, 2017

(54) LIGHT EMITTING DIODE LAMP

(71) Applicant: ADVANCED OPTOELECTRONIC TECHNOLOGY, INC., Hsinchu Hsien (TW)

(72) Inventors: Ming-Ta Tsai, Hsinchu (TW); Chung-Min Chang, Hsinchu (TW); Hao-Xiang Lin, Hsinchu (TW)

(73) Assignee: ADVANCED OPTOELECTRONIC TECHNOLOGY, INC., Hsinchu Hsien (TW)

( * ) Notice: Subject to any disclaimer, the term of this patent is extended or adjusted under 35 U.S.C. 154(b) by 27 days.

(21) Appl. No.: 14/310,792

(22) Filed: Jun. 20, 2014

(65) Prior Publication Data

US 2015/0049496 A1 Feb. 19, 2015

(30) Foreign Application Priority Data

Aug. 13, 2013 (CN) ..... 2013 1 0349684

(51) Int. Cl.
*F21V 29/60* (2015.01)
*F21V 29/67* (2015.01)

(52) U.S. Cl.
CPC ..... *F21V 29/67* (2015.01); *F21K 9/23* (2016.08); *F21K 9/232* (2016.08)

(58) Field of Classification Search
CPC ..... F21V 29/67; F21K 9/1355; F21K 9/135
See application file for complete search history.

(56) References Cited

U.S. PATENT DOCUMENTS 5,672,931 A * 9/1997 Kiss ..... F21V 13/08 313/24
8,915,624 B2 * 12/2014 Manahan ..... F21V 29/20 362/373
2009/0160344 A1 * 6/2009 Hsu ..... F21K 9/00 315/117
2010/0246166 A1 * 9/2010 Hsu ..... F21V 29/02 362/184
2011/0025211 A1 2/2011 Bae
2012/0128464 A1 * 5/2012 Lee ..... F04D 29/646 415/66
2012/0300455 A1 * 11/2012 Breidenassel ..... F21V 3/02 362/235
2012/0320593 A1 * 12/2012 Betsuda ..... F21K 9/135 362/249.02
2013/0051003 A1 2/2013 Fan
2014/0131016 A1 * 5/2014 Santoro ..... F04D 19/024 165/121

FOREIGN PATENT DOCUMENTS

CN 2658945 11/2004
CN 101463986 A 6/2009
CN 101986002 A 3/2011
TW 201104156 2/2011

* cited by examiner

*Primary Examiner* — Anh Mai
*Assistant Examiner* — Zachary J Snyder
(74) *Attorney, Agent, or Firm* — Zhigang Ma

(57) ABSTRACT

A light emitting diode (LED) lamp includes a hollow connector, an LED module mounted on the connector, and a fin unit received in the connector. The connector has an inlet and an outlet couple to the inlet. Heat generated from the LED module is transferred to the connector to dissipate. The fan unit includes a first fan and a second fan rotating along contrary directions.

11 Claims, 2 Drawing Sheets

LIGHT EMITTING DIODE LAMP

FIELD

The disclosure generally relates to light emitting diode (LED) lamps, and more particularly to an LED lamp having good heat dissipation efficiency.

BACKGROUND

LEDs have many beneficial characteristics, including low electrical power consumption, low heat generation, long lifetime, small volume, good impact resistance, fast response and excellent stability. These characteristics have enabled the LEDs to be widely used as a light source in electrical appliances and electronic devices.

DETAILED DESCRIPTION

An embodiment of an LED lamp in accordance with the present disclosure will now be described in detail below and with reference to the drawings.

Figure 1:
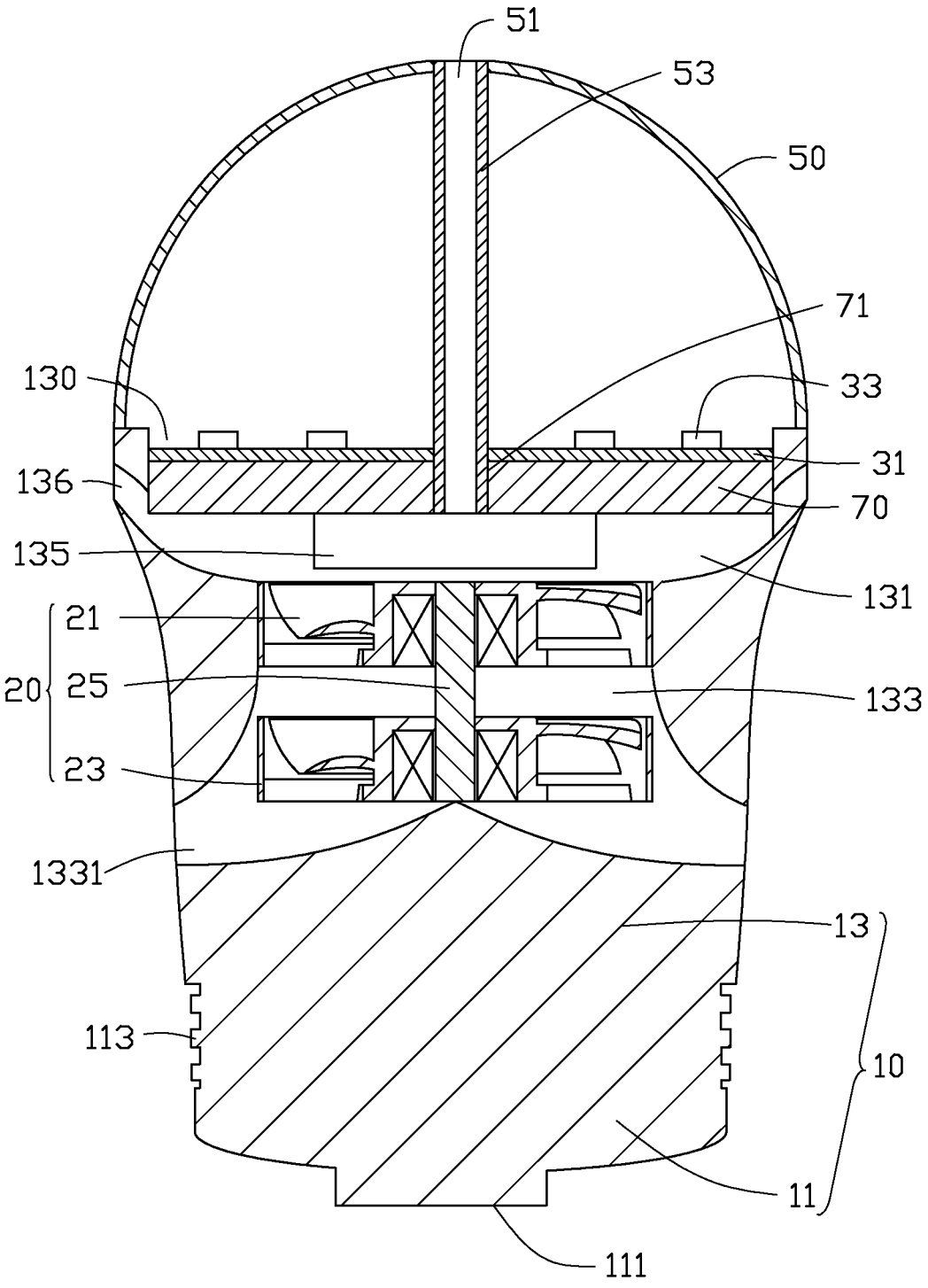
FIG. 1 is a cross-sectional view of an LED lamp according to an exemplary embodiment of the present disclosure.
Figure 2:
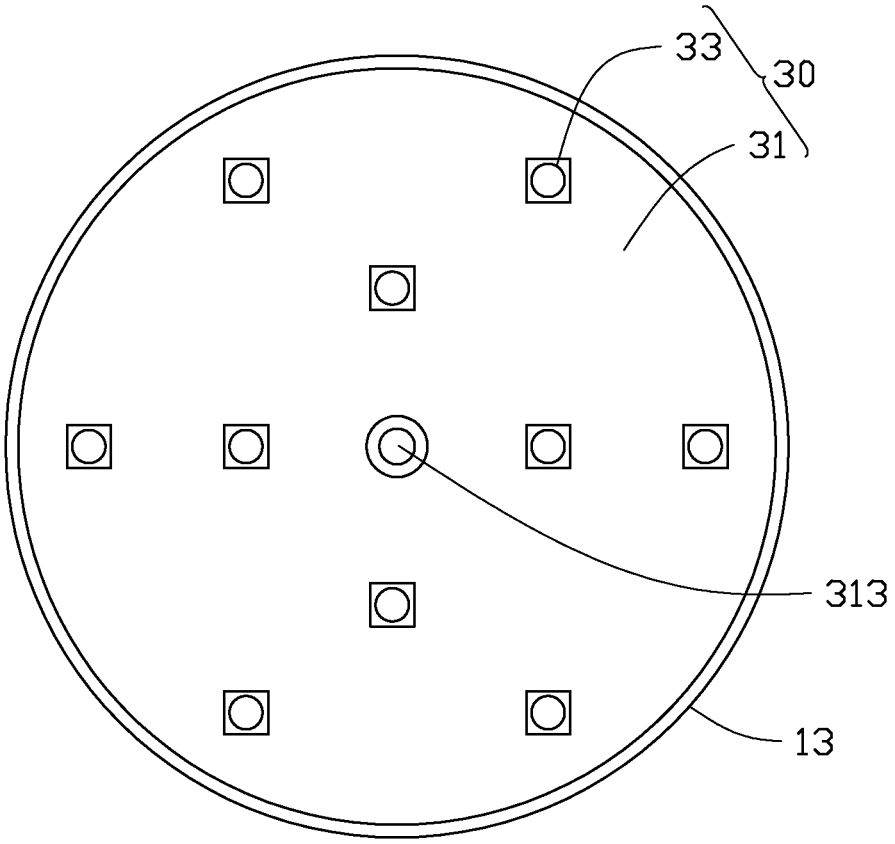
FIG. 2 is a top view of the LED lamp of FIG. 1, wherein an envelope of the LED lamp is removed for clarity.

Referring to FIGS. 1-2, an LED lamp in accordance with an exemplary embodiment of the disclosure includes a connecting member 10, an LED module 30 received in the connecting member 10, a fan unit 20 received in the connecting member 10, an envelope 50 mounted on the connecting member 10 and covering the LED module 30, and a heat sink 70 mounted on the connecting member 10 and directly contacting the LED module 30.

The connecting member 10 can be opaque and is used to electrically connect a power source (not shown). The connecting member 10 includes a holder 11 and a connector 13.

A vertical cross section of the holder 11 is rectangular. The holder 11 is configured for screwing to a socket (not shown) to electrically connect the power source. A metallic patch is formed on an outside of a bottom end of the holder 11. The metallic patch functions as a first electrode 111 of the LED lamp. A threaded periphery (not labeled) of the holder 11 functions as a second electrode 113 of the LED lamp to electrically connect the power source to drive the LED module 30 to lighten. The holder 11 is a standard element, so the LED lamp can be directly connect to a standard socket matching with the standard holder 11 to electrically connect with the power source. Thus, the LED lamp of the present disclosure can replace the traditional incandescent bulb and compact fluorescent bulb.

The connector 13 and the holder 11 are made of a single piece. The connector 13 extends upwardly from a top end of the holder 11. A vertical cross section of the connector 13 is trapezoidal and a width thereof is increased from a bottom end connecting the holder 11 to a top end away from the holder 11. The connector 13 is a hollow tube with the top end and the bottom end being closed. A central portion of the top end of the connector 13 is recessed to define a housing 130 to receive the heat sink 70 and the LED module 30 therein. An inner surface of the connector 13 defines an inner space therein. The inner space is divided into a temperature controlled chamber 131 and a receiving chamber 133 along a height direction of the LED lamp. The temperature controlled chamber 131 communicates with the receiving chamber 133 and is located at top of the connector 13. A temperature detector 135 is received in the temperature controlled chamber 131 and is fixed to a top of the temperature controlled chamber 131. The temperature detector 135 detects a temperature of the temperature controlled chamber 131. At least an inlet 136 is defined in a periphery of the top end of the connector 13. The inlet 136 communicates the temperature controlled chamber 131. An outlet 1331 is defined in a periphery of the bottom end of the connector 13. The outlet 1331 communicates the receiving chamber 133. A bore diameter of the receiving chamber 133 increases from a top portion connecting to the temperature controlled chamber 131 to a bottom portion away from the temperature controlled chamber 131.

The fan unit 20 includes a first fan 21 and a second fan 23. Each of the first fan 21 and the second fan 23 is a centrifugal fan. The first fan 21 is received in a joint of the temperature controlled chamber 131 and the receiving chamber 133. The first fan 21 rotates along a first direction. The second fan 23 faces and is spaced apart from the first fan 21. The second fan 23 is received in the receiving chamber 133 and connects with the first fan 21 via a bearing 25. The second fan 23 rotates in a second direction opposite to the first direction. The first fan 21 and the second fan 23 are controlled by different circuits which connect the temperature detector 135 and control the first fan 21 and the second fan 23 respectively or simultaneously according to different inputs received from the temperature detector 135.

The heat sink 70 is made of material having good heat conductive efficiency. The heat sink 70 absorbs heat of the LED module 30 and transfers the heat out of the connector 13 to dissipate. The heat sink 70 can be a vapor chamber, or a metallic plate and so on. A through hole 71 is defined in the heat sink 70.

Referring also to FIG. 2, the LED module 30 includes a print circuit board (PCB) 31 mounted on the heat sink 70 and a plurality of LEDs 33 arranged on the PCB 31. A size of the PCB 31 is equal to or smaller than that of the heat sink 70 to ensure an entirely bottom surface of the PCB 31 be mounted on a top surface of the heat sink 70. A through hole 313 is defined in a central portion of the PCB 31. A bore diameter of the through hole 313 is equal to the through hole 71 of the heat sink 70. The through hole 313 is aligned with and communicates with the through hole 71. A sum height of the heat sink 70 and the LED module 30 is less than a depth of the housing 130.

The envelope 50 is hemispherical and a bottom end thereof is mounted on the top end of the connector 13. A hollow tube 53 penetrates the envelope 50, the through holes 313, 71 and the top end of the connector 13 to define a passage 51 therein to allow cool air flow through the connecting member 10 from the passage 51. The hollow tube 53 and the envelope 50 can be made of a single piece.

During the operation of the LED lamp, the LEDs 33 emit light and generate heat. Part of the heat is absorbed by the heat sink 70 and transferred to the connecting member 10 where it is dissipated. Simultaneously, the temperature detector 135 detects the temperature of the temperature controlled chamber 131. When the temperature of the temperature controlled chamber 131 is lower than a predetermined temperature, only the first fan 21 is controlled to rotate in response to the input received from the temperature detector 135. In this state, the first fan 21 guides cool air flowing through the passage 51, the inlet 136 and into the temperature controlled chamber 131. The heat of the heat sink 70 and the connecting member 10 is further dissipated by the cool air. After the cool air absorbing the heat, the heated air is exhausted the connector 13 from the outlet 1331. When the temperature of the temperature controlled chamber 131 is larger than the predetermined temperature, both the first fan 21 and the second fan 23 are controlled to rotate in response to the input received from the temperature detector 135 to make the cool air flow through the connector 13 more quickly. Thus, the temperature of the LED lamp can be well controlled.

In this embodiment, the first fan 21 and the second fan 23 are received in the connector 13 and rotate in opposite directions, so that cool air guided by the first fan 21 and the second fan 23 flows through the LED lamp more quickly than a conventional LED lamp having a fan mounted on an outer side thereof. Thus, the heat of the LED lamp is dissipated quickly and the LED lamp has stable performance.

In this embodiment, the temperature detector 135 generating different inputs to control only the first fan 21 or both the first fan 21 and the second fan 23 simultaneously operating is environmentally friendly and energy efficient. Further, when the first fan 21 and the second fan 23 rotate with a high speed and in opposite directions, a heat dissipation efficiency of the LED lamp is improved 6-16% relative to two fans rotating in the same direction.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A light emitting diode (LED) lamp comprising:

a hollow connector having an inlet and an outlet coupled to the inlet;

an LED module mounted on the connector, heat generated from the LED module transferred to the connector to dissipate;

an envelope mounted on the connector and covering the LED module, the envelope comprising a hollow tube depressed from a top center of the envelope to the LED module, the hollow tube penetrating the connector and the LED module to allow cool air flow through the connector through the tube; and a fan unit received in the connector and comprising a first fan and a second fan rotating in opposite directions;

wherein the first fan is concentrically coupled to the second fan by a bearing, and the first and second fans are electrically controlled by different circuits.

2. The LED lamp of claim 1, wherein the first fan faces and is spaced apart from the second fan.

3. The LED lamp of claim 1, wherein a detector is received in the connector to control the fan unit.

4. The LED lamp of claim 3, wherein the first fan and the second fan operate respectively or simultaneously according to inputs from the detector.

5. The LED lamp of claim 4, wherein an inner surface of the connector defines an inner space therein, and the inner space is divided into a temperature controlled chamber and a receiving chamber along a height direction of the LED lamp, the detector is received in the temperature controlled chamber, the first fan is received in a joint of the temperature controlled chamber and the receiving chamber, and the second fan is received in the receiving chamber.

6. The LED lamp of claim 5, wherein the temperature controlled chamber communicates with the receiving chamber, the inlet is defined in a periphery of a top end of the connector, and the outlet is defined in a periphery of a bottom end of the connector.

7. The LED lamp of claim 6, wherein a bore diameter of the receiving chamber is increased from a top portion connecting to the temperature controlled chamber to a bottom portion away from the temperature controlled chamber.

8. The LED lamp of claim 1, wherein a heat sink is positioned between the LED module and the connector, and the tube penetrates the heat sink.

9. The LED lamp of claim 1 further comprising a holder connecting the connector, wherein the holder has two electrodes for electrically connecting power source.

10. A light emitting diode (LED) lamp comprising:

a hollow connector having an inlet and an outlet coupled to the inlet;

an LED module mounted on the connector, heat generated from the LED module transferred to the connector to dissipate;

an envelope mounted on the connector and covering the LED module, the envelope comprising a hollow tube depressed from a top center of the envelope to the LED module, the hollow tube penetrating the connector and the LED module to allow cool air flow through the connector through the tube; and a fan unit received in the connector and comprising a first fan and a second fan rotating in opposite contrary directions;

wherein the LED module and the connector are penetrated to defined a passage therein to allow cool air flowing into the connect from the passage and the inlet, having heat exchanges with the connect and exhausting the connector from the outlet;

wherein the first fan is concentrically coupled to the second fan by a bearing, and the first and second fans are electrically controlled by different circuits.

11. The LED lamp of claim 10, wherein a heat sink is positioned between the LED module and the connector, and the heat sink is penetrated by the tube.

* * * * *